United States Patent [19]

Lucey

[11] 4,446,766

[45] May 8, 1984

[54] BLADED ROTOR TURNING APPARATUS

[75] Inventor: Desmond C. Lucey, Charfield, near Bristol, England

[73] Assignee: Rolls Royce Limited, London, England

[21] Appl. No.: 269,610

[22] Filed: Jun. 2, 1981

[30] Foreign Application Priority Data

Jun. 19, 1980 [GB] United Kingdom ..... 8020134

[51] Int. Cl.[3] ..... B25B 23/142

[52] U.S. Cl. ..... 81/480; 74/96

[58] Field of Search ..... 81/467, 472, 478, 480, 81/440, 442, 443, 444, 446, 448, 449, 450, 460, 461, 91 R, 91 A, 91 C, 115; 74/96, 489, 504; 294/19 R, 116, 95; 403/160, 349, DIG. 7

[56] References Cited

U.S. PATENT DOCUMENTS

| | | | |
|---|---|---|---|
| 1,761,463 | 6/1930 | Beckett | 294/116 |
| 2,411,319 | 11/1946 | Duarte | 294/19 R |
| 2,831,383 | 4/1958 | Riess | 81/480 |
| 2,919,602 | 1/1960 | Spraragen | 81/480 |
| 3,175,280 | 3/1965 | Henges | 294/19 R |
| 4,193,739 | 3/1980 | Lucey . | |

FOREIGN PATENT DOCUMENTS

| | | |
|---|---|---|
| 2114916 | 3/1972 | Fed. Rep. of Germany . |
| 2543813 | 4/1976 | Fed. Rep. of Germany . |

*Primary Examiner*—James L. Jones, Jr.
*Attorney, Agent, or Firm*—Parkhurst & Oliff

[57] ABSTRACT

A bladed rotor turning tool comprising a rotatable shaft (1), a finger (7) articulated on the end of the shaft about an axis substantially perpendicular to the shaft axis, the inclination of the finger relative to the shaft axis being controlled by cam means (10,11,12 and 14) so that the finger varies between being substantially perpendicular to the shaft axis and being substantially parallel to the shaft axis at diametrically opposed shaft positions. The cam means may comprise a cam surface (14) at the end of a sleeve (13) in which the shaft is positioned and means (10,11,12) for urging the finger into contact with the cam surface. Two such fingers may be provided to improve turning.

9 Claims, 2 Drawing Figures

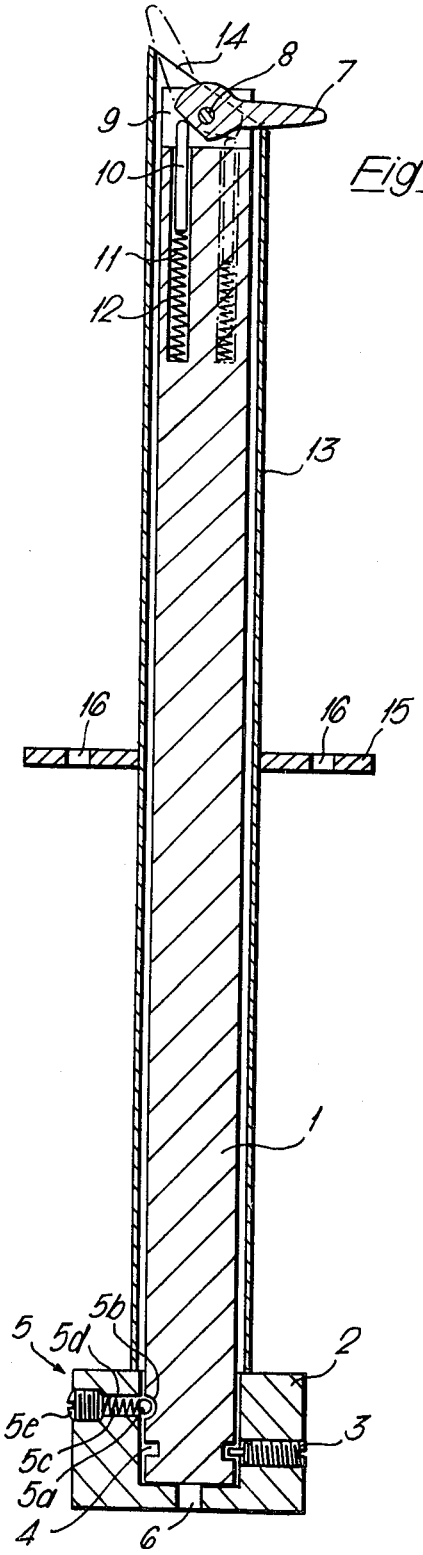
Fig. 1.
Fig. 2.
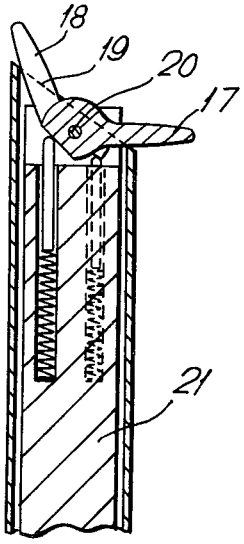

BLADED ROTOR TURNING APPARATUS

BACKGROUND OF THE INVENTION

This invention relates to apparatus for turning a bladed rotor of a machine.

It is often desired to turn the bladed rotor of a machine, e.g. a gas turbine engine, in order to inspect the individual blades for signs of wear or damage. Where it is not possible, or not desired, to turn the rotor directly by hand, the turning is conventionally effected using a compressed air tool having a nozzle which is positioned adjacent the rotor blades and which controllably emits air onto the blades to turn the rotor as desired. Such a compressed air turning tool is described in U.S. Pat. No. 4,193,739, assigned to the same assignee as the present application.

However, a source of compressed air may not be readily available, e.g. if it is desired to inspect the intermediate pressure compressor rotor of a triple-spool gas turbine engine on an aircraft in the field.

It is an object of the present invention to provide an apparatus for use in turning a bladed rotor of a machine, in which the apparatus may be manually operated.

According to the invention an apparatus for use in turning a bladed rotor of a machine comprises:

a rotatable shaft;

a finger attached to one end of the shaft, to be rotated therewith and to engage the blades of the rotor so as to rotate the rotor, the finger being articulated on the shaft about an axis substantially perpendicular to the shaft axis; and inclining means co-operating with the finger to incline the finger relative to the shaft axis in dependence on the rotational position of the shaft.

It will be appreciated that such an apparatus can be used in a small space adjacent the rotor and may be manually operated, obviating the need for a power supply such as a source of compressed air.

BRIEF DESCRIPTION OF PREFERRED EMBODIMENTS

Two apparatuses in accordance with the invention will now be described, by way of example only, with reference to the accompanying drawings, in which:

FIG. 1 shows a cross-sectional view of a first apparatus in accordance with the invention; and FIG. 2 shows a cross-sectional view, similar to that of FIG. 1, of part of a second apparatus in accordance with the invention.

Referring firstly to FIG. 1, a first apparatus for use in turning a bladed rotor of a gas turbine engine includes a shaft 1. The shaft 1 has attached to it at one end a handwheel 2. The handwheel 2 is axially fixed on the shaft by a locating pin 3 in the handwheel which locates in a circumferential groove 4 in the shaft. The handwheel 2 is rotationally coupled to the shaft by a torque limiting break-out device 5, comprising a small ball 5*a* which resiliently engages a dimple 5*b* in the shaft under the influence of a compression spring 5*c* located in a radially extending hole 5*d* in the handwheel and engaging a plug 5*e*. The handwheel 2 has a socket 6 to accept a standard drive.

At the other end of the shaft there is attached a finger 7. The finger 7 is articulated on the shaft by being rotatably mounted on a pin 8 in a diametrical slot 9, in the end of the shaft, the axis of the pin being perpendicular to the axis of the shaft 1. The finger 7 is urged towards a position (as shown in full in FIG. 1) perpendicular to the shaft axis by a rod 10 located in an axial recess 11 in the base of the slot 9 and urged out of the recess by a compression spring 12 located in the recess.

A cylindrical sleeve 13 is provided, in which the shaft 1 is positioned. The end of the sleeve 13 remote from the handwheel 2 is positioned around the end of the shaft 1 and provides a cam surface 14 against which the finger 7 is urged. The cam surface 14 is inclined so that when the shaft 1 is rotated, and with it the finger 7, the finger 7 follows the cam surface and varies its inclination with respect to the axis of the shaft, so that the a longitudinal axis of the finger varies between being substantially perpendicular to the shaft axis (in the position shown in full in FIG. 1) and being substantially parallel to the shaft axis (in the position shown dotted in FIG. 1, i.e. diametrically opposed to the position shown in full in FIG. 1) as the finger rotates. The sleeve 13 has fixed to it a flange 15 for locating the apparatus and fixing it, via bolt holes 16, to the casing of an engine whose rotor is to be turned.

In use of the apparatus in turning a bladed rotor (not shown) of a gas turbine engine (not shown), e.g. the intermediate pressure compressor rotor of a triple-spool gas turbine aircraft engine, the finger end of the apparatus is inserted into an inspection port (not shown) between the rotor to be turned and an adjacent ring of stator vanes (not shown) until the flange 15 abuts the engine casing and the apparatus is then bolted on. The axial position of the flange is chosen so that when the flange abuts the engine casing the finger end of the apparatus is at a desired position relative to the rotor to be turned, and the rotational position of the flange relative to the cam surface 14 is chosen so that when the finger 7 is at its position substantially perpendicular to the axis of the shaft 1 it lies between, and substantially perpendicular to, the blades of the rotor to be turned.

When the handwheel 2 is turned, either directly by hand or via the drive socket 6, the shaft 1 and the finger 7 turn, and the finger engages a blade and turns the rotor. As the shaft is turned further, the finger loses contact with the blade and comes to face the adjacent stator vanes. However, the stator vanes do not foul the finger, because as the finger moves towards the stator vanes the cam surface 14 inclines the finger until it is substantially parallel to the shaft axis and so does not touch the stator vanes. As the shaft is turned further the finger comes to face the rotor blades and the cam surface allows the finger to resume its position substantially perpendicular to the shaft axis. The finger then engages another rotor blade and turns the rotor.

Thus it will be appreciated that the apparatus can turn a bladed rotor in a restricted position in an engine and requires little or no working space, apart from the space to insert the shaft and the sleeve adjacent the rotor. It will also be appreciated that the torque break-out device 5 ensures that if the engine is stiff to turn then the blades will not be damaged by excessive force, the ball 5*a* moving out of the dimple 5*b* and the handwheel 2 slipping on the shaft 1. Thus the apparatus may be used to test a bladed rotor for free turning.

Referring now to FIG. 2, a second apparatus for use in turning a bladed rotor of a gas turbine engine is similar to the first apparatus of FIG. 1, and will only be described so far as to explain its difference. Whereas the first apparatus has a single finger 7 to turn rotor blades, the second apparatus has two such fingers 17 and 18.

The two fingers 17 and 18 are individually urged against a single sleeve end cam surface 19 by respective rods and compression springs as in the first apparatus. The fingers are rotatably mounted on a single pin 20, whose axis is substantially perpendicular to the axis of the shaft 21, so that the two fingers face in opposite directions and contact the cam surface 19 at substantially diametrically opposed positions.

It will be appreciated that the second apparatus operates in exactly the same way as the first apparatus, but turns a rotor twice as quickly and produces a smoother overall turning action since less time is wasted with a finger not engaging a blade and not turning the rotor.

I claim:

1. An apparatus for turning a bladed rotor of a machine comprising:

a rotatable shaft;

at least one finger secured to one end of said shaft, said finger being rotatable with said shaft about an axis extending along the longitudinal length of said shaft and being engagable with a blade of a rotor to rotate the rotor when the shaft is rotated, said finger being articulated on the shaft about an axis substantially perpendicular to the axis of the shaft; and an inclining means cooperating with the finger to incline said finger with respect to the longitudinal axis of the shaft in dependence upon the rotational position of said shaft, said inclining means being arranged to incline the finger so that a longitudinal axis of the finger is substantially perpendicular to the shaft axis at one rotational position of the shaft and is substantially parallel to the shaft axis at a substantially diametrically opposed position of the shaft.

2. An apparatus according to claim 1 wherein the inclining means comprises:

a cam surface positioned adjacent the finger; and urging means for urging the finger into contact with the cam surface.

3. An apparatus according to claim 2 wherein the urging means comprises:

a recess in the end of the shaft;

a compression spring located in the recess; and a rod located in the recess to be urged by the compression spring into contact with the finger, the rod contacting the finger on the opposite side of the shaft axis to that on which the finger contacts the cam surface.

4. An apparatus according to claim 2 wherein the cam surface is provided at an end of a sleeve in which the shaft is positioned.

5. An apparatus according to claim 1 wherein said at least one finger comprises two said fingers which face in substantially opposite directions.

6. An apparatus according to claim 5 wherein the two fingers are articulated about the same axis perpendicular to the shaft axis.

7. An apparatus according to claim 1 wherein there is provided at the end of the shaft remote from the end to which the finger is attached a handwheel for manually rotating the shaft.

8. An apparatus according to claim 7 wherein the handwheel is coupled to the shaft by a coupling which disengages upon the application of a predetermined torque.

9. An apparatus according to claim 7 wherein the handwheel includes means for connecting a mechanical drive.

* * * * *